US011217182B2

(12) United States Patent
Xuan et al.

(10) Patent No.: US 11,217,182 B2
(45) Date of Patent: Jan. 4, 2022

(54) POWER SOURCE VOLTAGE APPLICATION CIRCUIT, POWER SOURCE VOLTAGE APPLICATION METHOD, DISPLAY SUBSTRATE AND DISPLAY DEVICE

(71) Applicant: BOE TECHNOLOGY GROUP CO., LTD., Beijing (CN)

(72) Inventors: Minghua Xuan, Beijing (CN); Lei Wang, Beijing (CN); Xiaochuan Chen, Beijing (CN); Dongni Liu, Beijing (CN); Detao Zhao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 454 days.

(21) Appl. No.: 16/338,813

(22) PCT Filed: Oct. 18, 2018

(86) PCT No.: PCT/CN2018/110741
§ 371 (c)(1),
(2) Date: Apr. 2, 2019

(87) PCT Pub. No.: WO2019/179088
PCT Pub. Date: Sep. 26, 2019

(65) Prior Publication Data

US 2021/0327365 A1 Oct. 21, 2021

(30) Foreign Application Priority Data

Mar. 23, 2018 (CN) ..... 201810247887.2

(51) Int. Cl.
*G09G 3/3291* (2016.01)

(52) U.S. Cl.
CPC ..... *G09G 3/3291* (2013.01); *G09G 2310/061* (2013.01); *G09G 2330/028* (2013.01)

(58) Field of Classification Search
None
See application file for complete search history.

(56) References Cited

U.S. PATENT DOCUMENTS

2002/0105510 A1* 8/2002 Tsuchiya ..... G09G 3/3625 345/211
2007/0279405 A1* 12/2007 Agarwal ..... G09G 3/2965 345/211

(Continued)

FOREIGN PATENT DOCUMENTS

CN 101582978 A 11/2009
CN 101697269 A 4/2010

(Continued)

OTHER PUBLICATIONS

International Search Report and Written Opinion for Application No. PCT/CN2018/110741, dated Jan. 16, 2019, 11 Pages.

*Primary Examiner* — Chad M Dicke
(74) *Attorney, Agent, or Firm* — Brooks Kushman P.C.

(57) ABSTRACT

The present disclosure provides a power source voltage application circuit, including a power source voltage output end, an energy storage sub-circuitry, a resetting sub-circuitry and an output control sub-circuitry. A first end of the energy storage sub-circuitry is connected to a first node, and a second end of the energy storage sub-circuitry is connected to a second node. The resetting sub-circuitry is connected to a resetting control end, a reference voltage input tend, the first node, the second node and an initial voltage input end respectively. The output control sub-circuitry is connected to an output control end, a first voltage input end, the first node, the second node and the power source voltage output end respectively.

20 Claims, 5 Drawing Sheets

(56) References Cited

U.S. PATENT DOCUMENTS

| | | | | |
|---|---|---|---|---|
| 2008/0266280 | A1* | 10/2008 | Yang | G09G 3/296 345/211 |
| 2011/0157112 | A1 | 6/2011 | Shibata et al. | |
| 2013/0057532 | A1 | 3/2013 | Lee et al. | |
| 2017/0047002 | A1 | 2/2017 | Xuan et al. | |
| 2017/0116919 | A1 | 4/2017 | Ma | |
| 2017/0345515 | A1 | 11/2017 | Shang | |

FOREIGN PATENT DOCUMENTS

| | | | |
|---|---|---|---|
| CN | 103971640 | A | 8/2014 |
| CN | 104680980 | A | 6/2015 |
| CN | 105161134 | A | 12/2015 |

* cited by examiner

POWER SOURCE VOLTAGE APPLICATION CIRCUIT, POWER SOURCE VOLTAGE APPLICATION METHOD, DISPLAY SUBSTRATE AND DISPLAY DEVICE

CROSS-REFERENCE TO RELATED APPLICATION APPLICATIONS

This application is the U.S. national phase of PCT Application No. PCT/CN2018/110741 filed on Oct. 18, 2018, which claims priority to Chinese Patent Application No. 201810247887.2 filed on Mar. 23, 2018, which are incorporated herein by reference in their entireties.

TECHNICAL FIELD

The present disclosure relates to the field of power source voltage application technology, in particular to a power source voltage application circuit, a power source voltage application method, a display substrate and a display device.

BACKGROUND

As compared with an organic light-emitting diode (OLED), a miniature LED has such advantages as a simple manufacture process and a long service life, so it is expected to replace the OLED and become a next-generation display technology. However, the luminous efficiency of the miniature LED does not exceed that of the OLED, and a larger current needs to be provided so as to acquire a same brightness value. When the miniature LED is applied to a display panel, the power consumption for the wiring of the miniature LED is far greater than the power consumption for the light emission, and a majority part of a voltage across each of a cathode and an anode of the miniature LED may be wasted along wires. Hence, it is very difficult for the miniature LED to be adapted to a medium-or-large-size display product or a display product where low power consumption is required.

SUMMARY

In one aspect, the present disclosure provides in some embodiments a power source voltage application circuit, including an energy storage sub-circuitry, a resetting sub-circuitry and an output control sub-circuitry. A first end of the energy storage sub-circuitry is connected to a first node, and a second end of the energy storage sub-circuitry is connected to a second node. The resetting sub-circuitry is connected to a resetting control end, a reference voltage input end, the first node, the second node and an initial voltage input end, and configured to, under the control of the resetting control end, control the first node to be electrically connected to, or electrically disconnected from, the reference voltage input end, and control the second node to be electrically connected to, or electrically disconnected from, the initial voltage input end. The output control sub-circuitry is connected to an output control end, a first voltage input end, the first node, the second node and a power source voltage output end, and configured to, under the control of the output control end, control the first voltage input end to be electrically connected to, or electrically disconnected from, the second node, and control the first node to be electrically connected to, or electrically disconnected from, the power source voltage output end.

In some possible embodiments of the present disclosure, the energy storage sub-circuitry includes a storage capacitor, a first end of which is the first end of the energy storage sub-circuitry, and a second end of which is the second end of the energy storage sub-circuitry.

In some possible embodiments of the present disclosure, the resetting sub-circuitry includes: a first resetting transistor, a gate electrode of which is connected to the resetting control end, a first electrode of which is connected to the reference voltage input end, and a second electrode of which is connected to the first node; and a second resetting transistor, a gate electrode of which is connected to the resetting control end, a first electrode of which is connected to the initial voltage input end, and a second electrode of which is connected to the second node.

In some possible embodiments of the present disclosure, the output control sub-circuitry includes: a first output control transistor, a gate electrode of which is connected to the output control end, a first electrode of which is connected to the first voltage input end, and a second electrode of which is connected to the second node; and a second output control transistor, a gate electrode of which is connected to the output control end, a first electrode of which is connected to the power source voltage output end, and a second electrode of which is connected to the first node.

In some possible embodiments of the present disclosure, the first resetting transistor and the second resetting transistor are N-type transistors or P-type transistors.

In some possible embodiments of the present disclosure, the first output control transistor and the second output control transistor are N-type transistors or P-type transistors.

In some possible embodiments of the present disclosure, a first voltage from the first voltage input end is a high voltage.

In another aspect, the present disclosure provides in some embodiments a method for applying a power source voltage through the above-mentioned power source voltage application circuit, including: at a resetting stage, under the control of a resetting control end, controlling, by a resetting sub-circuitry, a first node to be electrically connected to a reference voltage input end and controlling, by the resetting sub-circuitry, a second node to be electrically connected to an initial voltage input end, and under the control of an output control end, controlling, by an output control sub-circuitry, a first voltage input end to be electrically disconnected from the second node, and controlling, by the output control sub-circuitry, the first node to be electrically disconnected from a power source voltage output end; and at a power source voltage output stage, under the control of the resetting control end, controlling, by the resetting sub-circuitry, the first node to be electrically disconnected from the reference voltage input end and controlling, by the resetting sub-circuitry, the second node to be electrically disconnected from the initial voltage input end, and under the control of the output control end, controlling, by the output control sub-circuitry, the first voltage input end to be electrically connected to the second node, and controlling, by the output control sub-circuitry, the first node to be electrically connected to the power source voltage output end, so as to output a power source voltage to the power source voltage output end.

In yet another aspect, the present disclosure provides in some embodiments a display substrate including the above-mentioned power source voltage application circuit.

In some possible embodiments of the present disclosure, the display substrate further includes a plurality of pixel circuits arranged in rows and columns, and each pixel circuit includes a power source voltage input end. The display substrate include one power source voltage application circuit, and a power source voltage output end of the power source voltage application circuit is connected to the power source voltage input end.

In some possible embodiments of the present disclosure, the display substrate further includes a plurality of pixel circuits arranged in rows and columns, and each pixel circuit includes a power source voltage input end. The display substrate includes N power source voltage application circuits, where N is an integer greater than 1. The display substrate is divided into N display regions, each display region includes the pixel circuits in at least one row, and each display region corresponds to one of the power source voltage application circuits. The power source voltage output end of each power source voltage application circuit is connected to the power source voltage input ends of all the pixel circuits arranged in the corresponding display region.

In some possible embodiments of the present disclosure, each pixel circuit further includes a pixel driving circuitry and a light-emitting element. The pixel driving circuitry is connected to the power source voltage input end, a corresponding gate line, a corresponding data line, and a first electrode of the light-emitting element, and a second electrode of the light-emitting element is connected to a second voltage input end.

In some possible embodiments of the present disclosure, the pixel driving circuitry includes a driving transistor, a storage sub-circuitry and a data write-in sub-circuitry. The data write-in sub-circuitry is connected to a corresponding gate line, a corresponding data line and a gate electrode of the driving transistor, and configured to, under the control of the corresponding gate line, control the corresponding data line to be electrically connected to, or electrically disconnected from, the gate electrode of the driving transistor. A first electrode of the driving transistor is connected to the power source voltage input end, and a second electrode of the driving transistor is connected to the first electrode of the light-emitting element. A first end of the storage sub-circuitry is connected to the gate electrode of the driving transistor, and a second end of the storage sub-circuitry is connected to the first electrode of the driving transistor.

In some possible embodiments of the present disclosure, the pixel driving circuitry includes a driving transistor, a data write-in sub-circuitry, a light-emission control sub-circuitry, an initialization sub-circuitry and a storage sub-circuitry. The data write-in sub-circuitry is connected to a gate electrode and a first electrode of the driving transistor, the first electrode of the light-emitting element, a corresponding data line, a corresponding gate line, a second electrode of the driving transistor and an initial voltage input end, and configured to, under the control of the corresponding gate line, control the first electrode of the driving transistor to be electrically connected to, or electrically disconnected from, the corresponding data line, control the gate electrode of the driving transistor to be electrically connected to, or electrically disconnected from, the second electrode of the driving transistor, and control the first electrode of the light-emitting element to be electrically connected to, or electrically disconnected from, the initial voltage input end. The light-emission control sub-circuitry is connected to a light-emission control end, the power source voltage input end, the first electrode and the second electrode of the driving transistor, and the first electrode of the light-emitting element, and configured to, under the control of the light-emission control end, control the power source voltage input end to be electrically connected to, or electrically disconnected from, the first electrode of the driving transistor, and control the second electrode of the driving transistor to be electrically connected to, or electrically disconnected from, the first electrode of the light-emitting element. The initialization sub-circuitry is connected to an initialization control end, the gate electrode of the driving transistor and the initial voltage input end, and configured to, under the control of the initialization control end, control the gate electrode of the driving transistor to be electrically connected to, or electrically disconnected from, the initial voltage input end. A first end of the storage sub-circuitry is connected to the power source voltage input end, and a second end of the storage sub-circuitry is connected to the gate electrode of the driving transistor.

In some possible embodiments of the present disclosure, the light-emitting element is a miniature LED.

In some possible embodiments of the present disclosure, the light-emitting element is an OLED.

In still yet another aspect, the present disclosure provides in some embodiments a power source voltage application method for use in the above-mentioned display substrate. Each pixel circuit of the display substrate includes a pixel driving circuitry and a light-emitting element. The power source voltage application method includes: at a resetting stage, under the control of a resetting control end, controlling, by a resetting sub-circuitry, a first node to be electrically connected to a reference voltage input end, and controlling, by the resetting sub-circuitry, a second node to be electrically connected to an initial voltage input end, and under the control of an output control end, controlling, by an output control sub-circuitry, a first voltage input end to be electrically disconnected from the second node, and controlling, by the output control sub-circuitry, the first node to be electrically disconnected from a power source voltage output end; and at a power source voltage output stage, under the control of the resetting control end, controlling, by a resetting sub-circuitry, the first node to be electrically disconnected from the reference voltage input end, and controlling, by the resetting sub-circuitry, the second node to be electrically disconnected from the initial voltage input end, and under the control of the output control end, controlling, by the output control sub-circuitry, the first voltage input end to be electrically connected to the second node, and controlling, by the output control sub-circuitry, the first node to be electrically connected to the power source voltage output end, so as to output a power source voltage to the power source voltage output end, and control power source voltage input ends of all the pixel circuits of the display substrate to receive the power source voltage, thereby to enable the pixel driving circuitry of each pixel circuit to generate a driving current for driving the light-emitting element of the pixel circuit at a corresponding light-emitting stage.

In still yet another aspect, the present disclosure provides in some embodiments a power source voltage application method for use in the above-mentioned display substrate. Each pixel circuit of the display substrate includes a pixel driving circuitry and a light-emitting element. An $n^{th}$ power source voltage application circuit of the display substrate corresponds to an $n^{th}$ display region. The $n^{th}$ power source voltage application circuit includes an $n^{th}$ energy storage sub-circuitry, an $n^{th}$ resetting sub-circuitry and an $n^{th}$ output control sub-circuitry. The $n^{th}$ resetting sub-circuitry is connected to an $n^{th}$ resetting control end, and the $n^{th}$ output control sub-circuitry is connected to an $n^{th}$ output control end. The $n^{th}$ display region corresponds to an $n^{th}$ voltage application period. The $n^{th}$ voltage application period includes an $n^{th}$ resetting stage and an $n^{th}$ power source voltage output stage arranged one after another. An $m^{th}$ power source voltage output stage includes a first output time period and a second output time period arranged one after another, where n is a positive integer smaller than or equal to N, m is a positive integer smaller than N, and N is an integer greater than 1. The power source voltage application method includes, within the $n^{th}$ voltage application period: at the $n^{th}$ resetting stage, under the control of the $n^{th}$ resetting control end, controlling, by the $n^{th}$ resetting sub-circuitry, a first end of the $n^{th}$ energy storage sub-circuitry to be electrically connected to a reference voltage input end, and controlling, by the $n^{th}$ resetting sub-circuitry, a second end of the $n^{th}$ energy storage sub-circuitry to be electrically connected to an initial voltage input end, and under the control of the $n^{th}$ output control end, controlling, by the $n^{th}$ output control sub-circuitry, a first voltage input end to be electrically disconnected from the second end of the $n^{th}$ energy storage sub-circuitry, and controlling, by the $n^{th}$ output control sub-circuitry, the first end of the $n^{th}$ energy storage sub-circuitry to be electrically disconnected from the $n^{th}$ power source voltage output end; and at the $n^{th}$ power source voltage output stage, under the control of the $n^{th}$ resetting control end, controlling, by the $n^{th}$ resetting sub-circuitry, the first end of the $n^{th}$ energy storage sub-circuitry to be electrically disconnected from the reference voltage input end, and controlling, by the $n^{th}$ resetting sub-circuitry, the second end of the $n^{th}$ energy storage sub-circuitry to be electrically disconnected from the initial voltage input end, and under the control of the $n^{th}$ output control end, controlling, by the $n^{th}$ output control sub-circuitry, the first voltage input end to be electrically connected to the second end of the $n^{th}$ energy storage sub-circuitry, and controlling, by the $n^{th}$ output control sub-circuitry, the first end of the $n^{th}$ energy storage sub-circuitry to be electrically connected to the $n^{th}$ power source voltage output end, so as to output the power source voltage to the $n^{th}$ power source voltage output end, and control the power source voltage input ends of all the pixel circuits in the $n^{th}$ display region to receive the power source voltage, thereby to enable the pixel driving circuitry of each pixel circuit in the $n^{th}$ display region to generate a driving current for driving the light-emitting element of the pixel circuit at a corresponding light-emitting stage. The first output time period of the $m^{th}$ power source voltage output stage is a resetting stage included in an $(m+1)^{th}$ voltage application period, where m is a positive integer smaller than N.

In still yet another aspect, the present disclosure provides in some embodiments a display device including the above-mentioned display substrate.

BRIEF DESCRIPTION OF THE DRAWINGS

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort.

DETAILED DESCRIPTION OF THE EMBODIMENTS

In order to make the objects, the technical solutions and the advantages of the present disclosure more apparent, the present disclosure will be described hereinafter in a clear and complete manner in conjunction with the drawings and embodiments.

In the following description, specific details of configurations and assemblies are merely provided to facilitate the understanding of the present disclosure. It should be appreciated that, a person skilled in the art may make further modifications and alternations without departing from the spirit of the present disclosure. In addition, for clarification, any known function and structure will not be described hereinafter.

It should be further appreciated that, such phrases as "one embodiment" and "one of the embodiments" intend to indicate that the features, structures or characteristics are contained in at least one embodiment of the present disclosure, rather than referring to a same embodiment. In addition, the features, structures or characteristics may be combined in any embodiment or embodiments in an appropriate manner.

The features and principles of the present disclosure will be described hereinafter in conjunction with the drawings and embodiments. The following embodiments are for illustrative purposes only, but shall not be used to limit the scope of the present disclosure.

All transistors adopted in the embodiments of the present disclosure may be TFTs, field effect transistors (FETs) or any other elements having an identical characteristic. In order to differentiate two electrodes other than a gate electrode from each other, one of the two electrodes is called as first electrode and the other is called as second electrode. In actual use, the first electrode may be a drain electrode while the second electrode may be a source electrode, or the first electrode may be a source electrode while the second electrode may be a drain electrode.

Figure 1:
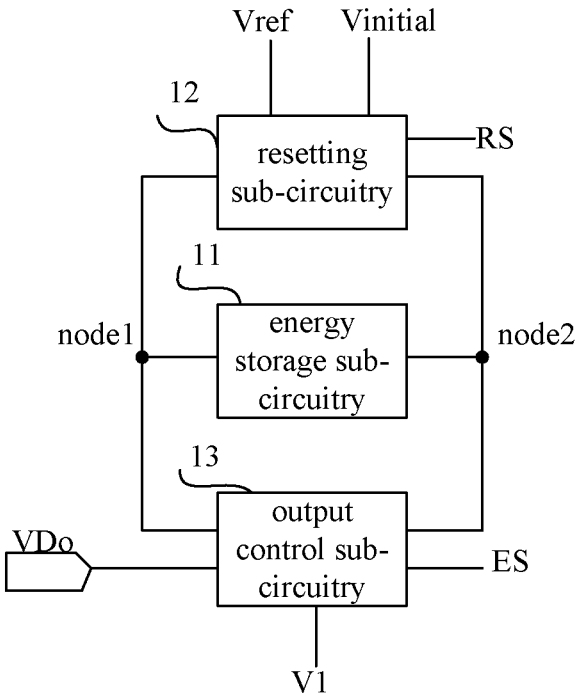
FIG. 1 is a schematic view showing a power source voltage application circuit according to certain embodiments of the present disclosure.

As shown in FIG. 1, the present disclosure provides in some embodiments a power source voltage application circuit, which includes an energy storage sub-circuitry 11, a resetting sub-circuitry 12 and an output control sub-circuitry 13.

A first end of the energy storage sub-circuitry 11 is connected to a first node node1, and a second end of the energy storage sub-circuitry 11 is connected to a second node node2.

The resetting sub-circuitry 12 is connected to a resetting control end Rs, a reference voltage input end, the first node node1, the second node node2 and an initial voltage input end respectively, and configured to, under the control of the resetting control end Rs, control the first node node1 to be electrically connected to, or electrically disconnected from, the reference voltage input end, and control the second node node2 to be electrically connected to, or electrically disconnected from, the initial voltage input end. The reference voltage input end is configured to input a reference voltage Vref, and the initial voltage input end is configured to input an initial voltage Vinitial.

The output control sub-circuitry 13 is connected to an output control end Es, a first voltage input end, the first node node1, the second node node2 and a power source voltage output end VDo respectively, and configured to, under the control of the output control end Es, control the first voltage input end to be electrically connected to, or electrically disconnected from, the second node node2, and control the first node node1 to be electrically connected to, or electrically disconnected from, the power source voltage output end VDo. The first voltage input end is configured to input a first voltage V1.

In actual use, the first voltage V1 from the first voltage input end may be, but not limited to, a high voltage VDD.

According to the power source voltage application circuit in the embodiments of the present disclosure, a power source voltage is outputted by the power source voltage output end VDo at a power source voltage output stage. In addition, the energy storage sub-circuitry 11 functions as to block a current, so it is able to reduce the energy loss for a power source voltage wire in a display substrate to which the power is supplied by the power source voltage application circuit. To be specific, a light-emitting element of a pixel circuit is isolated from the first voltage input end of the power source voltage application circuit, and a driving current generated by a driving transistor for driving the light-emitting element to emit light may not flow to the first voltage input end, so it is able to reduce the power consumption.

A working procedure of the power source voltage application circuit will be described as follows.

At a resetting stage, under the control of the resetting control end Rs, the resetting sub-circuitry 12 may control the first node node1 to be electrically connected to the reference voltage input end so as to enable a potential at the first node node1 to be Vref, and control the second node node2 to be electrically connected to the initial voltage input end so as to enable a potential at the second node node2 to be Vinitial. Under the control of the output control end Es, the output control sub-circuitry 13 may control the first voltage input end to be electrically disconnected from the second node node2, and control the first node node1 to be electrically disconnected from the power source voltage output end VDo.

At the power source voltage output stage, under the control of the resetting control end Rs, the resetting sub-circuitry 12 may control the first node node1 to be electrically disconnected from the reference voltage input end, and control the second node node2 to be electrically disconnected from the initial voltage input end. Under the control of the output control end Es, the output control sub-circuitry 13 may control the first voltage input end to be electrically connected to the second node node2 so as to enable the potential at the second node node2 to be V1. At this time, because a voltage across the energy storage sub-circuitry 11 does not change, depending on the law of conservation of charge, the potential at the first node node1 may jump to (V1−Vinitial)+Vref. The output control sub-circuitry 13 may further control the first node node1 to be electrically connected to the power source voltage output end VDo, so as to output the power source voltage to the power source voltage output end VDo. A value of the power source voltage may be just (V1−Vinitial)+Vref.

To be specific, the energy storage sub-circuitry may include a storage capacitor, a first end of which is just the first end of the energy storage sub-circuitry, and a second end of which is just the second end of the energy storage sub-circuitry.

To be specific, the resetting sub-circuitry may include: a first resetting transistor, a gate electrode of which is connected to the resetting control end, a first electrode of which is connected to the reference voltage input end, and a second electrode of which is connected to the first node; and a second resetting transistor, a gate electrode of which is connected to the resetting control end, a first electrode of which is connected to the initial voltage input end, and a second electrode of which is connected to the second node.

In actual use, the first resetting transistor and the second resetting transistor may be N-type transistors or P-type transistors.

To be specific, the output control sub-circuitry may include: a first output control transistor, a gate electrode of which is connected to the output control end, a first electrode of which is connected to the first voltage input end, and a second electrode of which is connected to the second node; and a second output control transistor, a gate electrode of which is connected to the output control end, a first electrode of which is connected to the power source voltage output end, and a second electrode of which is connected to the first node.

In actual use, the first output control transistor and the second output control transistor may be N-type transistors or P-type transistors.

The power source voltage application circuit will be described hereinafter illustratively.

Figure 2:
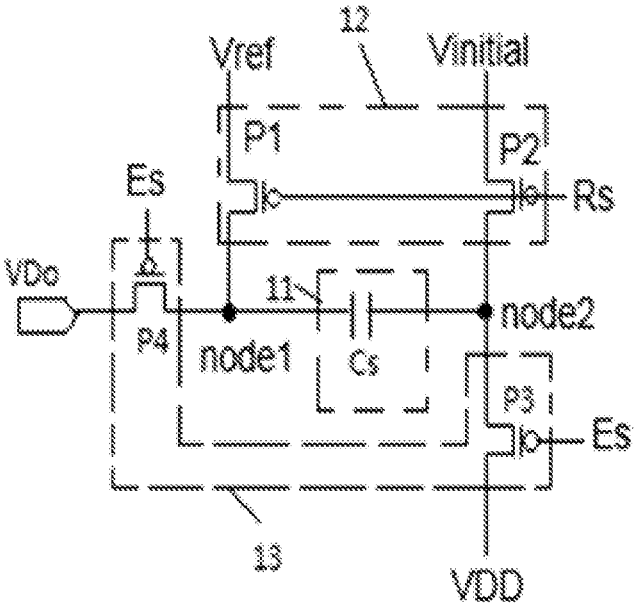
FIG. 2 is a circuit diagram of the power source voltage application circuit according to certain embodiments of the present disclosure.

As shown in FIG. 2, the power source voltage application circuit may include the energy storage sub-circuitry 11, the resetting sub-circuitry 12 and the output control sub-circuitry 13.

The energy storage sub-circuitry 11 may include a storage capacitor Cs, a first end of which is connected to the first node node1, and a second end of which is connected to the second node node2.

The resetting sub-circuitry 12 may include: a first resetting transistor P1, a gate electrode of which is connected to the resetting control end Rs, a drain electrode of which is connected to the reference voltage input end, and a source electrode of which is connected to the first node node1; and a second resetting transistor P2, a gate electrode of which is connected to the resetting control end Rs, a drain electrode of which is connected to the initial voltage input end, and a source electrode of which is connected to the second node node2.

Here, the reference voltage input end is configured to input the reference voltage Vref, and the initial voltage input end is configured to input the initial voltage Vinitial.

The output control sub-circuitry 13 may include: a first output control transistor P3, a gate electrode of which is connected to the output control end Es, a drain electrode of which is connected to the first voltage input end, and a source electrode of which is connected to the second node node2; and a second output control transistor P4, a gate electrode of which is connected to the output control end Es, a drain electrode of which is connected to the power source voltage output end VDo, and a source electrode of which is connected to the first node node1.

In FIG. 2, all the transistors, including P1, P2, P3 and P4, are P-type transistors. However, in actual use, these transistors may also be N-type transistors, i.e., the types of the transistors will not be particularly defined herein.

In FIG. 2, the first voltage input end is configured to input the high voltage VDD.

In FIG. 2, a value of Vref may be zero (0), and the reference voltage input end is configured to input, but not limited to, a low voltage. When Vref is applied to a power source voltage input end of each pixel circuit, a driving transistor of the pixel circuit for driving a light-emitting element to emit light may be in an OFF state.

In FIG. 2, a value of Vinitial may be 0, and the initial voltage input end is configured to input, but not limited to, a low voltage.

Figure 3:
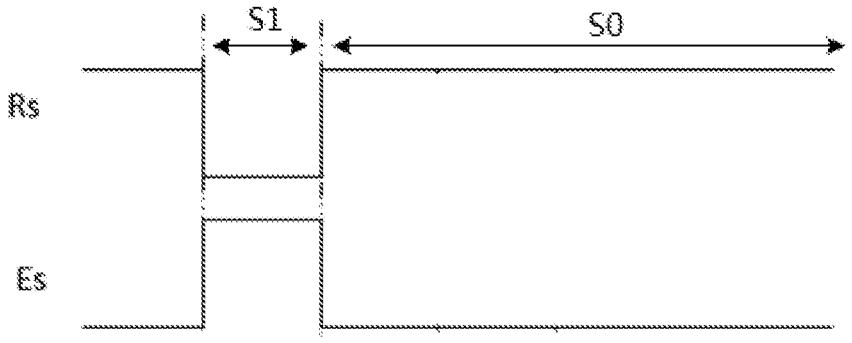
FIG. 3 is a sequence diagram of the power source voltage application circuit according to certain embodiments of the present disclosure.

As shown in FIG. 3, during the operation of the power source voltage application circuit in FIG. 2, at the resetting stage S1, Rs may output a low level, so as to turn on P1 and P2, thereby to enable the potential at node1 to be Vref, and the potential at node2 to be Vinitial. Es may output a high level, so as to turn off P3 and P4.

At the power source voltage output stage S0, Rs may output a high level, so as to turn off P1 and P2. Es may output a low level, so as to turn on P3 and P4, thereby to enable the potential at node2 to be the high voltage VDD and enable node1 to be electrically connected to VDo. Because a difference between the potentials at the first end and the second end of Cs remains unchanged, depending on the law of conservation of charge, at this time the potential at node1 may be Vref+(VDD−Vinitial), i.e., the power source voltage outputted to the power source voltage output end VDo may be Vref+(VDD−Vinitial). The power source voltage may be applied to the power source voltage input end of the pixel circuit, so as to enable the driving transistor of the pixel circuit to drive the light-emitting element to emit light. Because a current is incapable of flowing from the first end of the storage capacitor Cs to the second end of the storage capacitor Cs, a driving current for the pixel circuit (the driving current is generated by the driving transistor to drive the light-emitting element to emit light) may not flow to the first voltage input end. In this regard, it is able to reduce the energy loss for the power source voltage wire. At a light-emitting stage of the light-emitting element, the potential at node1 may be maintained due to the high voltage VDD from the first voltage input end.

The present disclosure further provides in some embodiments a method for applying a power source voltage through the above-mentioned power source voltage application circuit, which includes: at a resetting stage, under the control of the resetting control end Rs, controlling, by the resetting sub-circuitry 12, the first node node1 to be electrically connected to the reference voltage input end and controlling, by the resetting sub-circuitry 12, the second node node2 to be electrically connected to the initial voltage input end, and under the control of the output control end Es, controlling, by the output control sub-circuitry 13, the first voltage input end to be electrically disconnected from the second node node2, and controlling, by the output control sub-circuitry 13, the first node node1 to be electrically disconnected from the power source voltage output end; and at a power source voltage output stage, under the control of the resetting control end Rs, controlling, by the resetting sub-circuitry 12, the first node node1 to be electrically disconnected from the reference voltage input end and controlling, by the resetting sub-circuitry 12, the second node node2 to be electrically disconnected from the initial voltage input end, and under the control of the output control end Es, controlling, by the output control sub-circuitry 13, the first voltage input end to be electrically connected to the second node node2, and controlling, by the output control sub-circuitry 13, the first node node1 to be electrically connected to the power source voltage output end, so as to output a power source voltage to the power source voltage output end.

According to the power source voltage application method in the embodiments of the present disclosure, the power source voltage is outputted by the power source voltage output end at the power source voltage output stage. In addition, the energy storage sub-circuitry functions as to block a current, so it is able to reduce the energy loss for a power source voltage wire in a display substrate to which the power is supplied by the power source voltage application circuit. To be specific, a light-emitting element of a pixel circuit is isolated from the first voltage input end of the power source voltage application circuit, and a driving current generated by a driving transistor for driving the light-emitting element to emit light may not flow to the first voltage input end, so it is able to reduce the power consumption.

The present disclosure further provides in some embodiments a display substrate including at least one of the above-mentioned power source voltage application circuits.

In some possible embodiments of the present disclosure, the display substrate may further include a plurality of pixel circuits arranged in rows and columns, and each pixel circuit may include a power source voltage input end. The display substrate may include one power source voltage application circuit, and a power source voltage output end of the power source voltage application circuit may be connected to a power source in each pixel unit of the display substrate. The power source voltage output end of the power source voltage application circuit may be connected to the power source voltage input end of each pixel circuit.

In actual use, all the pixel circuits of the display substrate may be connected to the power source voltage application circuit, so that the power source voltage is applied to the pixel circuits through the power source voltage application circuit. In this way, it is able to reduce the energy loss for the power source voltage wire in the display substrate to which the power is applied by the power source voltage application circuit, thereby to reduce the power consumption.

In another possible embodiment of the present disclosure, the display substrate may further include a plurality of pixel circuits arranged in rows and columns, and each pixel circuit may include a power source voltage input end. The display substrate may include N power source voltage application circuits, where N is an integer greater than 1. The display substrate may be divided into N display regions, each display region may include the pixel circuits in at least one row, and each display region may correspond to one of the power source voltage application circuits. The power source voltage output end of each power source voltage application circuit may be connected to the power source voltage input ends of all the pixel circuits arranged in the corresponding display region.

The display substrate will be described hereinafter by taking N=3 as an example.

Figure 4:
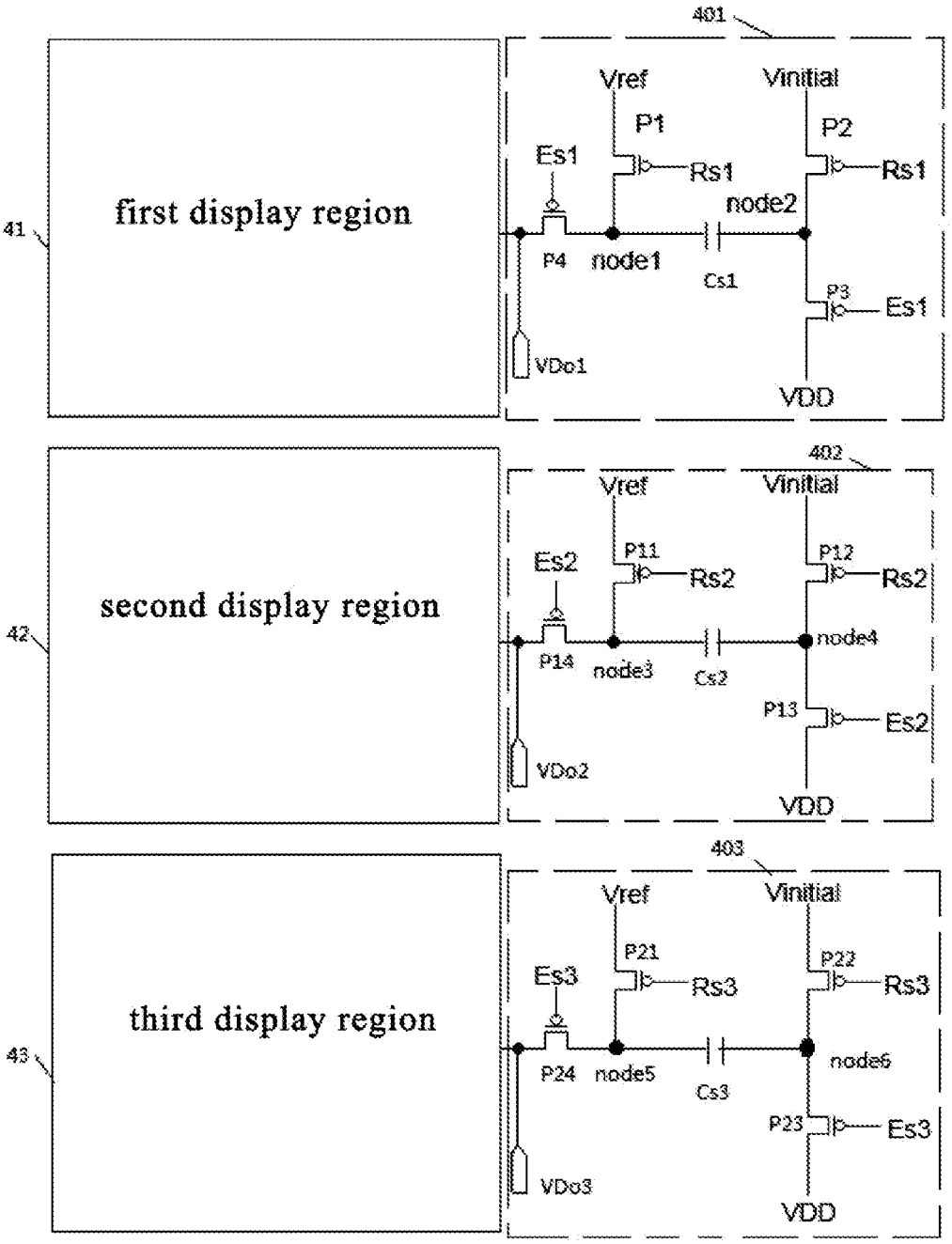
FIG. 4 is a circuit diagram of a display substrate according to certain embodiments of the present disclosure.

As shown in FIG. 4, the display substrate may include a plurality of pixel circuits arranged in rows and columns. The display substrate may be divided into three display regions, and each display region may include the pixel circuits in at least one row. In FIG. 4, reference numeral 41 represents a first display region, reference numeral 42 represents a second display region, and reference numeral 43 represents a third display region.

The display substrate may further include a first power source voltage application circuit 401, a second power source voltage application circuit 402 and a third power source voltage application circuit 403.

The first power source voltage application circuit 401 may include a first energy sub-circuitry, a first resetting sub-circuitry and a first output control sub-circuitry.

The first energy storage sub-circuitry may include a first storage capacitor Cs1, a first end of which is connected to the first node node1, and a second end of which is connected to the second node node2.

The first resetting sub-circuitry may include: a first resetting transistor P1, a gate electrode of which is connected to a first resetting control end Rs1, a drain electrode of which is connected to the reference voltage input end, and a source electrode of which is connected to the first node node1; and a second resetting transistor P2, a gate electrode of which is connected to the first resetting control end Rs1, a drain electrode of which is connected to the initial voltage input end, and a source electrode of which is connected to the second node node2. The reference voltage input end is configured to input the reference voltage Vref, and the initial voltage input end is configured to input the initial voltage Vinitial.

The first output control sub-circuitry may include: a first output control transistor P3, a gate electrode of which is connected to a first output control end Es1, a drain electrode of which is connected to the first voltage input end, and a source electrode of which is connected to the second node node2; and a second output control transistor P4, a gate electrode of which is connected to the first output control end Es1, a drain electrode of which is connected to a first power source voltage output end VDo1, and a source electrode of which is connected to the first node node1.

The second power source voltage application circuit 402 may include a second energy storage sub-circuitry, a second resetting sub-circuitry and a second output control sub-circuitry.

The second energy storage sub-circuitry may include a second storage capacitor Cs2, a first end of which is connected to a third node node3, and a second end of which is connected to a fourth node node4.

The second resetting sub-circuitry may include: a third resetting transistor P11, a gate electrode of which is connected to a second resetting control end Rs2, a drain electrode of which is connected to the reference voltage input end, and a source electrode of which is connected to the third node node3; and a fourth resetting transistor P12, a gate electrode of which is connected to the second resetting control end Rs2, a drain electrode of which is connected to the initial voltage input end, and a source electrode of which is connected to the fourth node node4.

The second output control sub-circuitry may include: a third output control transistor P13, a gate electrode of which is connected to a second output control end Es2, a drain electrode of which is connected to the first voltage input end, and a source electrode of which is connected to the fourth node node4; and a fourth output control transistor P14, a gate electrode of which is connected to the second output control end Es2, a drain electrode of which is connected to a second power source voltage output end VDo2, and a source electrode of which is connected to the third node node3.

The third power source voltage application circuit 403 may include a third energy storage sub-circuitry, a third resetting sub-circuitry and a third output control sub-circuitry.

The third energy storage sub-circuitry may include a third storage capacitor Cs3, a first end of which is connected to a fifth node node5, and a second end of which is connected to a sixth node node6.

The third resetting sub-circuitry may include: a fifth resetting transistor P21, a gate electrode of which is connected to a third resetting control end Rs3, a drain electrode of which is connected to the reference voltage input end, and a source electrode of which is connected to the fifth node node5; and a sixth resetting transistor P22, a gate electrode of which is connected to the third resetting control end Rs3, a drain electrode of which is connected to the initial voltage input end, and a source electrode of which is connected to the sixth node node6.

The third output control sub-circuitry may include: a fifth output control transistor P23, a gate electrode of which is connected to a third output control end Es3, a drain electrode of which is connected to the first voltage input end, and a source electrode of which is connected to the sixth node node6; and a sixth output control transistor P24, a gate electrode of which is connected to the third output control end Es3, a drain electrode of which is connected to a third power source voltage output end VDo3, and a source electrode of which is connected to the fifth node node5.

In FIG. 4, the transistors of the first power source voltage application circuit 401, the second power source voltage application circuit 402 and the third power source voltage application circuit 403 are all P-type transistors. However, in actual use, these transistors may also be N-type transistors, i.e., the types of the transistors will not be particularly defined herein.

Figure 5:
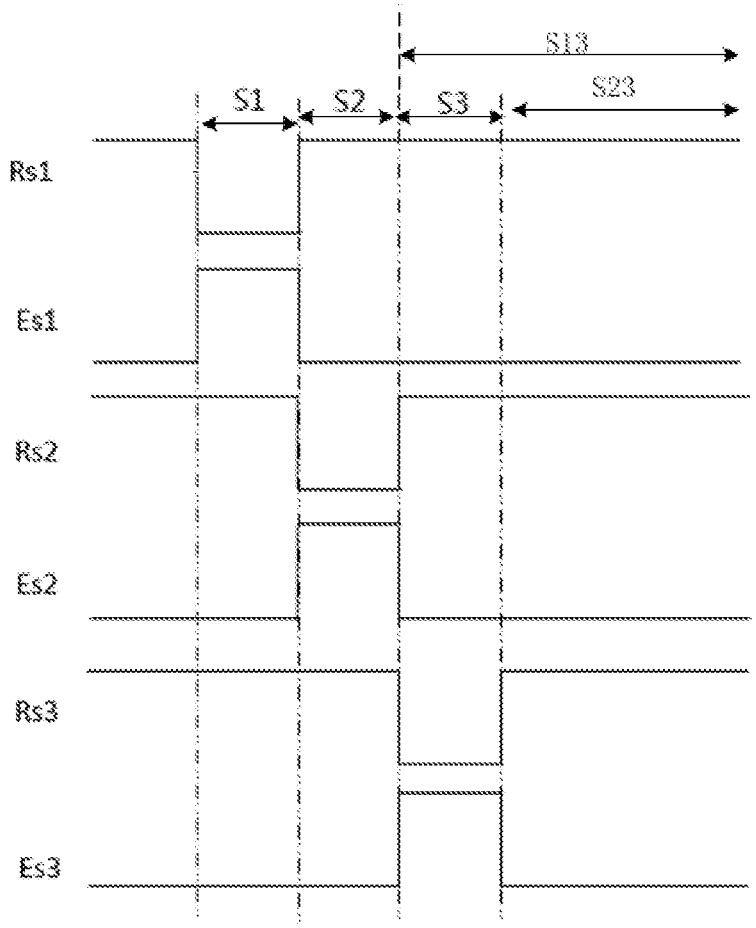
FIG. 5 is a sequence diagram of the display substrate according to certain embodiments of the present disclosure.

As shown in FIG. 5, during the operation of the display substrate in FIG. 4, the first display region may correspond to a first voltage application period which includes a first resetting stage S1 and a first power source voltage output stage arranged one after another. The first power source voltage output stage may include a first output time period S2 and a second output time period S13 arranged one after another. The second display region may correspond to a second voltage application period which includes a second resetting stage and a second power source voltage output stage arranged one after another. The second power source voltage output stage may include a third output time period S3 and a fourth output time period S23 arranged one after another. The third display region may correspond to a third voltage application period which includes a third resetting stage and a third power source voltage output stage arranged one after another. The third power source voltage output stage may be just the fourth output time period S23 of the second voltage application period.

The first output time period S2 of the first power source voltage output stage may be the second resetting stage of the second voltage application period, and the third output time period S3 of the second power source voltage output stage may be the third resetting stage of the third voltage application period.

As shown in FIG. 5, during the operation of the display substrate in FIG. 4, at the first resetting stage S1 of the first voltage application period, Rs1 may output a low level, and Es1 may output a high level, so as to turn on P1 and P2, and turn off P3 and P4, thereby to apply Vref to node1, apply Vinitial to node2, and store a voltage in Cs1.

Within the first output time period S2 and the second output time period S13 of the first voltage application period, Rs1 may output a high level, and Es1 may output a low level, so as to turn off P1 and P2, and turn on P3 and P4, thereby to enable the potential at node2 to be changed from Vinitial to VDD, and enable the potential at node1 to be changed to Vref+(VDD−Vinitial) (depending on the law of conservation of charge). At this time, the power source voltage applied by the first power source voltage application circuit 401 to VDo1 may be equal to Vref+(VDD−Vinitial).

Within the first output time period S2 (i.e., the resetting stage of the second voltage application period), Rs2 may output a low level, and Es2 may output a high level, so as to turn on P11 and P12, and turn off P13 and P14, thereby to apply Vref to node3, apply Vinitial to node4, and store a voltage in Cs2.

Within the first output time period S3 and the fourth output time period S23 of the second voltage application period, Rs2 may output a high level, and Es2 may output a low level, so as to turn off P11 and P12, and turn on P13 and P14, thereby to enable the potential at node4 to be changed from Vinitial to VDD, and enable the potential at node3 to be changed to Vref+(VDD−Vinitial) (depending on the law of conservation of charge). At this time, the power source voltage applied by the second power source voltage application circuit 402 to VDo2 may be equal to Vref+(VDD−Vinitial).

Within the first output time period S3 of the second voltage application period (i.e., the resetting stage of the third voltage application period), Rs3 may output a low level, and Es3 may output a high level, so as to turn on P21 and P22, and turn off P23 and P24, thereby to apply Vref to node5, apply Vinitial to node6, and store a voltage in Cs3.

At the third power source voltage output stage of the third voltage application period (i.e., the fourth output time period S23 of the second voltage application period), Rs3 may output a high level, and Es3 may output a low level, so as to turn off P21 and P22, and turn on P23 and P24, thereby to enable the potential at node6 to be changed from Vinitial to VDD, and enable the potential at node5 to be changed to Vref+(VDD−Vinitial) (depending on the law of conservation of charge). At this time, the power source voltage applied by the third power source voltage application circuit 403 to VDo3 may be equal to Vref+(VDD−Vinitial).

During the operation of the display substrate, Cs1, Cs2 and Cs3 may function as to block the current, so the driving current for driving the light-emitting element of each pixel circuit may not flow to the first voltage input end for inputting the high voltage VDD. As a result, it is able to reduce the energy loss for the power source voltage wire of the display substrate, thereby to reduce the power consumption for the wire.

In the embodiments of the present disclosure, it is able to effectively eliminate the energy loss for the power source voltage wire located beyond an active display region.

During the implementation, the pixel circuit may include a power source voltage input end, a pixel driving circuitry and a light-emitting element. The pixel driving circuitry may be connected to the power source voltage input end, a corresponding gate line, a corresponding data line, and a first electrode of the light-emitting element. A second electrode of the light-emitting element may be connected to a second voltage input end. The power source voltage input end may be connected to the power source voltage output end of the power source voltage application circuit. The power source voltage application circuit may output the power source voltage via the power source voltage output end to the power source voltage input end.

To be specific, the light-emitting element may be a miniature LED or an OLED.

Figure 6:
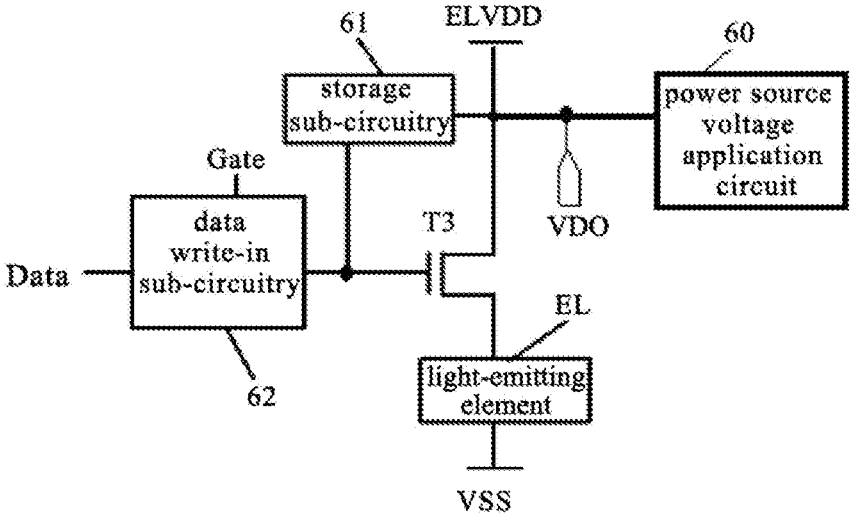
FIG. 6 is a circuit diagram of a pixel circuit of the display substrate according to certain embodiments of the present disclosure.

As shown in FIG. 6, the pixel driving circuitry may include a driving transistor T3, a storage sub-circuitry 61 and a data write-in sub-circuitry 62.

The data write-in sub-circuitry 62 may be connected to a corresponding gate line Gate, a corresponding data line Data and a gate electrode of the driving transistor T3, and configured to, under the control of the corresponding gate line Gate, control the corresponding data line Data to be electrically connected to, or electrically disconnected from, the gate electrode of the driving transistor T3.

A first electrode of the driving transistor T3 may be connected to a power source voltage input end ELVDD, a second electrode of the driving transistor T3 may be connected to a first electrode of the light-emitting element EL, and a second electrode of the light-emitting element EL is configured to receive a low voltage VSS.

A first end of the storage sub-circuitry 61 may be connected to the gate electrode of the driving transistor T3, and a second end of the storage sub-circuitry 61 may be connected to the first electrode of the driving transistor T3.

As shown in FIG. 6, the power source voltage input end VDD may be connected to the power source voltage output end VDo of the power source voltage application circuit 60. The power source voltage application circuit 60 may apply the power source voltage via the power source voltage output end VDo to ELVDD, so as to drive the pixel driving circuitry to operate normally. In addition, the energy storage sub-circuitry of the power source voltage application circuit 60 may function as to block the current, so it is able to isolate the light-emitting element EL of the pixel circuit in FIG. 6 from the first voltage input end (not shown in FIG. 6) of the power source voltage application circuit 60, and prevent the driving current generated by the driving transistor T3 for driving the light-emitting element EL to emit light from flowing to the first voltage input end, thereby to reduce the power consumption.

In FIG. 6, T3 may be a P-type transistor, or an N-type transistor, i.e., a type of T3 will not be particularly defined herein. The first electrode of T3 may be a source electrode and the second electrode thereof may be a drain electrode, or the first electrode of T3 may be a drain electrode and the second electrode thereof may be a source electrode.

In actual use, the light-emitting element EL may be an OLED or a miniature LED. The first electrode of the light-emitting element EL may be an anode, and the second electrode thereof may be a cathode.

Figure 7:
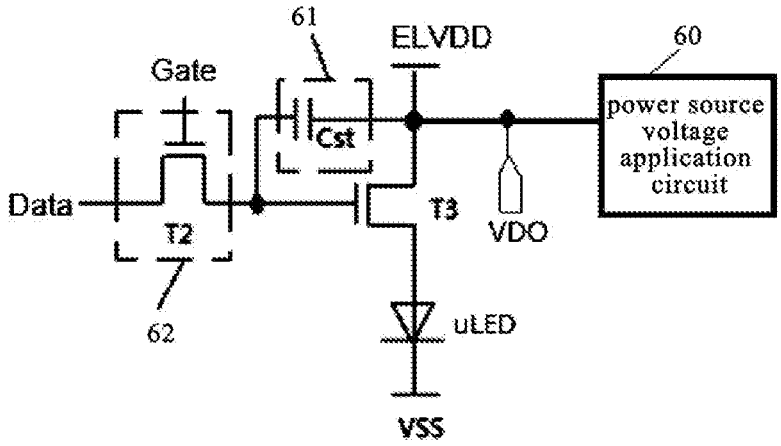
FIG. 7 is another circuit diagram of the pixel circuit of the display substrate according to certain embodiments of the present disclosure.

As shown in FIG. 7, on the basis of the pixel driving circuitry in FIG. 6, the storage sub-circuitry 61 may include a capacitor Cst, the data write-in sub-circuitry 62 may include a data write-in transistor T2, and the light-emitting element may be a miniature LED (uLED).

A first end of Cst may be the first end of the storage sub-circuitry 61, and a second end thereof may be the second end of the storage sub-circuitry 61.

A gate electrode of T2 may be connected to the corresponding gate line Gate, a drain electrode thereof may be connected to the corresponding data line Data, and a source electrode thereof may be connected to the gate electrode of T3.

An anode of the miniature LED may be the first electrode of the light-emitting element, and a cathode of the miniature LED may be the second electrode of the light-emitting element.

In FIG. 7, ELVDD may be connected to the power source voltage output end VDo of the power source voltage application circuit 60. The energy storage sub-circuitry of the power source voltage application circuit 60 may function as to block the current, so it is able to isolate the miniature LED (uLED) of the pixel circuit in FIG. 7 from the first voltage input end (not shown in FIG. 7) of the power source voltage application circuit 60, and prevent the driving current generated by the driving transistor T3 for driving the miniature LED (uLED) to emit light from flowing to the first voltage input end, thereby to reduce the power consumption.

In FIG. 7, T2 may be an N-type transistor or a P-type transistor, i.e., a type of T2 will not be particularly defined herein.

In another possible embodiment of the present disclosure, the pixel driving circuitry may include a driving transistor, a storage sub-circuitry, a data write-in sub-circuitry, a light-emission control sub-circuitry and an initialization sub-circuitry. A first end of the storage sub-circuitry may be connected to the power source voltage input end, and a second end thereof may be connected to a gate electrode of the driving transistor.

The data write-in sub-circuitry may be connected to the gate electrode and a first electrode of the driving transistor, the first electrode of the light-emitting element, a corresponding data line, a corresponding gate line, a second electrode of the driving transistor and the initial voltage input end, and configured to, under the control of the corresponding gate line, control the first electrode of the driving transistor to be electrically connected to, or electrically disconnected from, the corresponding data line, control the gate electrode of the driving transistor to be electrically connected to, or electrically disconnected from, the second electrode of the driving transistor, and control the first electrode of the light-emitting element to be electrically connected to, or electrically disconnected from, the initial voltage input end. The initial voltage input end is configured to input the initial voltage.

The light-emission control sub-circuitry may be connected to a light-emission control end, the power source voltage input end, the first electrode and the second electrode of the driving transistor, and the first electrode of the light-emitting element, and configured to, under the control of the light-emission control end, control the power source voltage input end to be electrically connected to, or electrically disconnected from, the first electrode of the driving transistor, and control the second electrode of the driving transistor to be electrically connected to, or electrically disconnected from, the first electrode of the light-emitting element.

The initialization sub-circuitry may be connected to an initialization control end, the gate electrode of the driving transistor and the initial voltage input end, and configured to, under the control of the initialization control end, control the gate electrode of the driving transistor to be electrically connected to, or electrically disconnected from, the initial voltage input end.

In the embodiments of the present disclosure, the driving transistor may be a P-type transistor or an N-type transistor, i.e., a type of the driving transistor will not be particularly defined herein. The first electrode of the driving transistor may be a source electrode and the second electrode thereof may be a drain electrode, or the first electrode of the driving transistor may be a drain electrode and the second electrode thereof may be a source electrode.

In actual use, the light-emitting element may be an OLED or a miniature LED, the first electrode of the light-emitting element may be an anode, and the second electrode of the light-emitting element may be a cathode.

Figure 8:
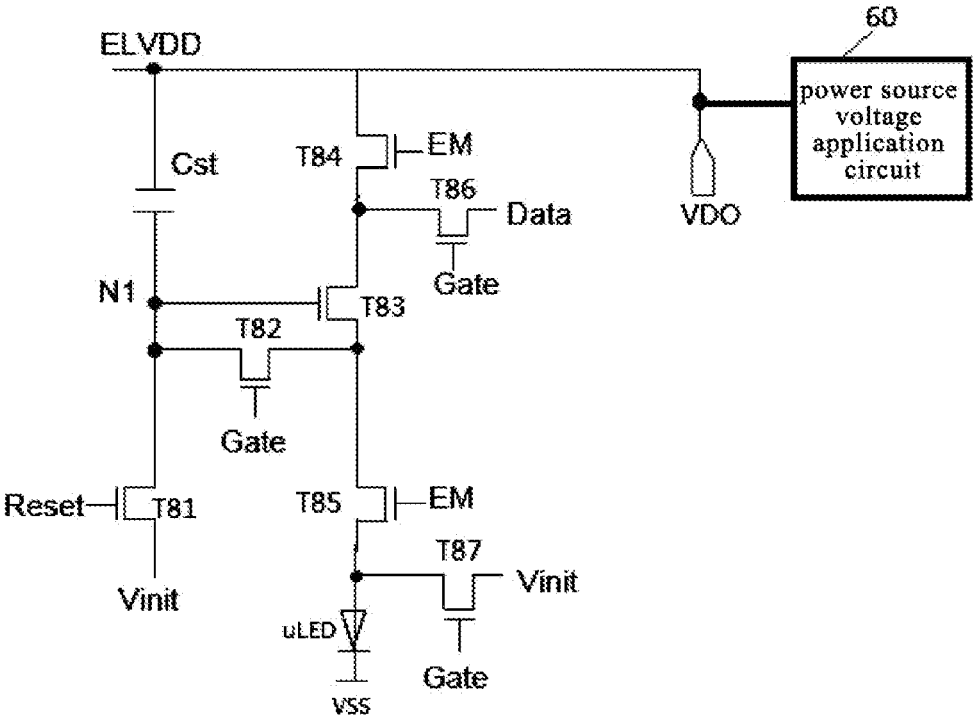
FIG. 8 is yet another circuit diagram of the pixel circuit of the display substrate according to certain embodiments of the present disclosure.

As shown in FIG. 8, on the basis of the above-mentioned pixel driving circuitry, T83 represents the driving transistor, the storage sub-circuitry may include a capacitor Cst, the data write-in sub-circuitry may include a compensation control transistor T82, an initial voltage write-in transistor T87 and a data write-in transistor T86, and the light-emitting element may be a miniature LED (uLED).

An anode of the miniature LED (uLED) may be the first electrode of the light-emitting element, and a cathode thereof may be the second electrode of the light-emitting element.

A first end of Cst may be the first end of the storage sub-circuitry, and a second end thereof may be the second end of the storage sub-circuitry.

A gate electrode of T82 may be connected to Gate, a drain electrode thereof may be connected to a gate electrode of T83, and a source electrode thereof may be connected to a second electrode of T83.

A gate electrode of T86 may be connected to Gate, a drain electrode thereof may be connected to Data, and a source electrode thereof may be connected to a first electrode of T83.

A gate electrode of T87 may be connected to Gate, a drain electrode thereof may be connected to the initial voltage input end, and a source electrode thereof may be connected to the anode of uLED. The initial voltage input end is configured to input the initial voltage Vinitial.

The light-emission control sub-circuitry may include a first light-emission control transistor T84 and a second light-emission control transistor T85. A gate electrode of T84 may be connected to EM, a drain electrode thereof may be connected to ELVDD, and a source electrode thereof may be connected to the first electrode of T83. A gate electrode T85 may be connected to EM, a drain electrode thereof may be connected to the second electrode of T83, and a source electrode thereof may be connected to the anode of uLED.

The initialization sub-circuitry may include an initialization transistor T81, a gate electrode of which is connected to Reset, a drain electrode of which is connected to the gate electrode of T83, and a source electrode of which is connected to the initial voltage input end.

As shown in FIG. 8, the power source voltage input end ELVDD may be connected to the power source voltage output end VDo of the power source voltage application circuit 60. The power source voltage application circuit 60 may apply the power source voltage to ELVDD via the power source voltage output end VDo, so as to enable the pixel driving circuit to operate normally.

In FIG. 8, the power source voltage input end ELVDD may be connected to the power source voltage output end VDo of the power source voltage application circuit 60. The energy storage sub-circuitry of the power source voltage application circuit 60 may function as to block the current, so it is able to isolate the miniature LED (uLED) of the pixel circuit in FIG. 8 from the first voltage input end (not shown in FIG. 8) of the power source voltage application circuit 60, and prevent the driving current generated by the driving transistor T3 for driving the miniature LED (uLED) to emit light from flowing to the first voltage input end, thereby to reduce the power consumption.

In FIG. 8, each transistor may be an N-type transistor or a P-type transistor, i.e., a type of each transistor will not be particularly defined herein.

The pixel circuit in FIG. 6 or 8 may be a miniature LED pixel circuit manufactured through a low temperature polysilicon (LTPS) process.

The present disclosure further provides in some embodiments a power source voltage application method for use in the above-mentioned display substrate. The display substrate includes a plurality of pixel circuits arranged in rows and columns, and each pixel circuit includes a power source voltage input end. The display substrate further includes one power source voltage application circuit, and a power source voltage output end of the power source voltage application circuit is connected to the power source voltage input end of each pixel circuit of the display substrate. Each pixel circuit of the display substrate further includes a pixel driving circuitry and a light-emitting element. The power source voltage application method includes: at a resetting stage, under the control of a resetting control end, controlling, by a resetting sub-circuitry, a first node to be electrically connected to a reference voltage input end and controlling, by the resetting sub-circuitry, a second node to be electrically connected to an initial voltage input end, and under the control of an output control end, controlling, by an output control sub-circuitry, a first voltage input end to be electrically disconnected from the second node, and controlling, by the output control sub-circuitry, the first node to be electrically disconnected from a power source voltage output end; and at a power source voltage output stage, under the control of the resetting control end, controlling, by the resetting sub-circuitry, the first node to be electrically disconnected from the reference voltage input end and controlling, by the resetting sub-circuitry, the second node to be electrically disconnected from the initial voltage input end, and under the control of the output control end, controlling, by the output control sub-circuitry, the first voltage input end to be electrically connected to the second node, and controlling, by the output control sub-circuitry, the first node to be electrically connected to the power source voltage output end, so as to output a power source voltage to the power source voltage output end, and control the power source voltage input ends of all the pixel circuits of the display substrate to receive the power source voltage, thereby to enable the pixel driving circuitry of each pixel circuit to generate a driving current for driving the light-emitting element of the pixel circuit at a corresponding light-emitting stage.

According to the power source voltage application method in the embodiments of the present disclosure, the power source voltage is outputted by the power source voltage output end at the power source voltage output stage. In addition, the energy storage sub-circuitry functions as to block a current, so it is able to reduce the energy loss for a power source voltage wire in a display substrate to which the power is supplied by the power source voltage application circuit. To be specific, the light-emitting element of the pixel circuit is isolated from the first voltage input end of the power source voltage application circuit, and a driving current generated by the driving transistor for driving the light-emitting element to emit light may not flow to the first voltage input end, so it is able to reduce the power consumption.

The present disclosure further provides in some embodiments a power source voltage application method for use in the above-mentioned display substrate. Each pixel circuit of the display substrate includes a pixel driving circuitry and a light-emitting element. An $n^{th}$ power source voltage application circuit of the display substrate corresponds to an $n^{th}$ display region. The $n^{th}$ power source voltage application circuit includes an $n^{th}$ energy storage sub-circuitry, an $n^{th}$ resetting sub-circuitry and an $n^{th}$ output control sub-circuitry. The $n^{th}$ resetting sub-circuitry is connected to an $n^{th}$ resetting control end, and the $n^{th}$ output control sub-circuitry is connected to an $n^{th}$ output control end. The $n^{th}$ display region corresponds to an $n^{th}$ voltage application period. The $n^{th}$ voltage application period includes an $n^{th}$ resetting stage and an $n^{th}$ power source voltage output stage arranged one after another. An $m^{th}$ power source voltage output stage includes a first output time period and a second output time period arranged one after another, where n is a positive integer smaller than or equal to N, m is a positive integer smaller than N, and N is an integer greater than 1. The power source voltage application method includes, within the $n^{th}$ voltage application period: at the $n^{th}$ resetting stage, under the control of the $n^{th}$ resetting control end, controlling, by the $n^{th}$ resetting sub-circuitry, a first end of the $n^{th}$ energy storage sub-circuitry to be electrically connected to a reference voltage input end, and controlling, by the $n^{th}$ resetting sub-circuitry, a second end of the $n^{th}$ energy storage sub-circuitry to be electrically connected to an initial voltage input end, and under the control of the $n^{th}$ output control end, controlling, by the $n^{th}$ output control sub-circuitry, a first voltage input end to be electrically disconnected from the second end of the $n^{th}$ energy storage sub-circuitry, and controlling, by the $n^{th}$ output control sub-circuitry, the first end of the $n^{th}$ energy storage sub-circuitry to be electrically disconnected from the $n^{th}$ power source voltage output end; and at the $n^{th}$ power source voltage output stage, under the control of the $n^{th}$ resetting control end, controlling, by the $n^{th}$ resetting sub-circuitry, the first end of the $n^{th}$ energy storage sub-circuitry to be electrically disconnected from the reference voltage input end, and controlling, by the $n^{th}$ resetting sub-circuitry, the second end of the $n^{th}$ energy storage sub-circuitry to be electrically disconnected from the initial voltage input end, and under the control of the $n^{th}$ output control end, controlling, by the $n^{th}$ output control sub-circuitry, the first voltage input end to be electrically connected to the second end of the $n^{th}$ energy storage sub-circuitry, and controlling, by the $n^{th}$ output control sub-circuitry, the first end of the $n^{th}$ energy storage sub-circuitry to be electrically connected to the $n^{th}$ power source voltage output end, so as to output the power source voltage to the $n^{th}$ power source voltage output end, and control the power source voltage input ends of all the pixel circuits in the $n^{th}$ display region to receive the power source voltage, thereby to enable the pixel driving circuitry of each pixel circuit in the $n^{th}$ display region to generate a driving current for driving the light-emitting element of the pixel circuit at a corresponding light-emitting stage. The first output time period of the $m^{th}$ power source voltage output stage is a resetting stage included in an $(m+1)^{th}$ voltage application period, where m is a positive integer smaller than N.

In other words, when the display substrate includes at least two power source voltage application circuits and a current power source voltage application circuit is outputting the power source voltage at the power source voltage output stage, a next power source voltage application circuit may be reset within the first output time period of the power source voltage output stage.

The present disclosure further provides in some embodiments a display device including the above-mentioned display substrate. The display device may be any product or member having a display function, e.g., a mobile phone, a flat-panel computer, a television, a display, a laptop computer, a digital photo frame or a navigator.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A power source voltage application circuit, comprising an energy storage sub-circuitry, a resetting sub-circuitry and an output control sub-circuitry, wherein a first end of the energy storage sub-circuitry is connected to a first node, and a second end of the energy storage sub-circuitry is connected to a second node;

the resetting sub-circuitry is connected to a resetting control end, a reference voltage input end, the first node, the second node and an initial voltage input end, and configured to, under the control of the resetting control end, control the first node to be electrically connected to, or electrically disconnected from, the reference voltage input end, and control the second node to be electrically connected to, or electrically disconnected from, the initial voltage input end; and the output control sub-circuitry is connected to an output control end, a first voltage input end, the first node, the second node and a power source voltage output end, and configured to, under the control of the output control end, control the first voltage input end to be electrically connected to, or electrically disconnected from, the second node, and control the first node to be electrically connected to, or electrically disconnected from, the power source voltage output end.

2. The power source voltage application circuit according to claim 1, wherein the energy storage sub-circuitry comprises a storage capacitor, a first end of which is the first end of the energy storage sub-circuitry, and a second end of which is the second end of the energy storage sub-circuitry.

3. The power source voltage application circuit according to claim 1, wherein the resetting sub-circuitry comprises:

a first resetting transistor, a gate electrode of which is connected to the resetting control end, a first electrode of which is connected to the reference voltage input end, and a second electrode of which is connected to the first node; and a second resetting transistor, a gate electrode of which is connected to the resetting control end, a first electrode of which is connected to the initial voltage input end, and a second electrode of which is connected to the second node.

4. The power source voltage application circuit according to claim 1, wherein the output control sub-circuitry comprises:

a first output control transistor, a gate electrode of which is connected to the output control end, a first electrode of which is connected to the first voltage input end, and a second electrode of which is connected to the second node; and a second output control transistor, a gate electrode of which is connected to the output control end, a first electrode of which is connected to the power source voltage output end, and a second electrode of which is connected to the first node.

5. The power source voltage application circuit according to claim 3, wherein the first resetting transistor and the second resetting transistor are N-type transistors or P-type transistors.

6. The power source voltage application circuit according to claim 4, wherein the first output control transistor and the second output control transistor are N-type transistors or P-type transistors.

7. The power source voltage application circuit according to claim 1, wherein a first voltage from the first voltage input end is a high voltage.

8. A method for applying a power source voltage through the power source voltage application circuit according to claim 1, comprising:

at a resetting stage, under the control of a resetting control end, controlling, by a resetting sub-circuitry, a first node to be electrically connected to a reference voltage input end and controlling, by the resetting sub-circuitry, a second node to be electrically connected to an initial voltage input end, and under the control of an output control end, controlling, by an output control sub-circuitry, a first voltage input end to be electrically disconnected from the second node, and controlling, by the output control sub-circuitry, the first node to be electrically disconnected from a power source voltage output end; and at a power source voltage output stage, under the control of the resetting control end, controlling, by the resetting sub-circuitry, the first node to be electrically disconnected from the reference voltage input end and controlling, by the resetting sub-circuitry, the second node to be electrically disconnected from the initial voltage input end, and under the control of the output control end, controlling, by the output control sub-circuitry, the first voltage input end to be electrically connected to the second node, and controlling, by the output control sub-circuitry, the first node to be electrically connected to the power source voltage output end, to output a power source voltage to the power source voltage output end.

9. A display substrate, comprising at least one power source voltage application circuit according to claim 1.

10. The display substrate according to claim 9, further comprising a plurality of pixel circuits arranged in rows and columns, wherein each pixel circuit comprises a power source voltage input end, the display substrate comprises one power source voltage application circuit, and a power source voltage output end of the power source voltage application circuit is connected to the power source voltage input end.

11. The display substrate according to claim 9, further comprising a plurality of pixel circuits arranged in rows and columns, wherein each pixel circuit comprises a power source voltage input end, the display substrate comprises N power source voltage application circuits, where N is an integer greater than 1, wherein the display substrate is divided into N display regions, each display region comprises the pixel circuits in at least one row, and each display region corresponds to one of the power source voltage application circuits, wherein the power source voltage output end of each power source voltage application circuit is connected to the power source voltage input ends of all the pixel circuits arranged in the corresponding display region.

12. The display substrate according to claim 10, wherein each pixel circuit further comprises a pixel driving circuitry and a light-emitting element, the pixel driving circuitry is connected to the power source voltage input end, a corresponding gate line, a corresponding data line, and a first electrode of the light-emitting element, and a second electrode of the light-emitting element is connected to a second voltage input end.

13. The display substrate according to claim 12, wherein the pixel driving circuitry comprises a driving transistor, a storage sub-circuitry and a data write-in sub-circuitry;

the data write-in sub-circuitry is connected to a corresponding gate line, a corresponding data line and a gate electrode of the driving transistor, and configured to, under the control of the corresponding gate line, control the corresponding data line to be electrically connected to, or electrically disconnected from, the gate electrode of the driving transistor;

a first electrode of the driving transistor is connected to the power source voltage input end, and a second electrode of the driving transistor is connected to the first electrode of the light-emitting element; and a first end of the storage sub-circuitry is connected to the gate electrode of the driving transistor, and a second end of the storage sub-circuitry is connected to the first electrode of the driving transistor.

14. The display substrate according to claim 12, wherein the pixel driving circuitry comprises a driving transistor, a data write-in sub-circuitry, a light-emission control sub-circuitry, an initialization sub-circuitry and a storage sub-circuitry;

the data write-in sub-circuitry is connected to a gate electrode and a first electrode of the driving transistor, the first electrode of the light-emitting element, a corresponding data line, a corresponding gate line, a second electrode of the driving transistor and an initial voltage input end respectively, and configured to, under the control of the corresponding gate line, control the first electrode of the driving transistor to be electrically connected to, or electrically disconnected from, the corresponding data line, control the gate electrode of the driving transistor to be electrically connected to, or electrically disconnected from, the second electrode of the driving transistor, and control the first electrode of the light-emitting element to be electrically connected to, or electrically disconnected from, the initial voltage input end;

the light-emission control sub-circuitry is connected to a light-emission control end, the power source voltage input end, the first electrode and the second electrode of the driving transistor, and the first electrode of the light-emitting element respectively, and configured to, under the control of the light-emission control end, control the power source voltage input end to be electrically connected to, or electrically disconnected from, the first electrode of the driving transistor, and control the second electrode of the driving transistor to be electrically connected to, or electrically disconnected from, the first electrode of the light-emitting element;

the initialization sub-circuitry is connected to an initialization control end, the gate electrode of the driving transistor and the initial voltage input end respectively, and configured to, under the control of the initialization control end, control the gate electrode of the driving transistor to be electrically connected to, or electrically disconnected from, the initial voltage input end; and a first end of the storage sub-circuitry is connected to the power source voltage input end, and a second end of the storage sub-circuitry is connected to the gate electrode of the driving transistor.

15. The display substrate according to claim 12, wherein the light-emitting element is a miniature light-emitting diode (uLED).

16. The display substrate according to claim 12, wherein the light-emitting element is an organic light-emitting diode (OLED).

17. A power source voltage application method for use in the display substrate according to claim 10, wherein each pixel circuit of the display substrate comprises a pixel driving circuitry and a light-emitting element, the power source voltage application method comprising:

at a resetting stage, under the control of a resetting control end, controlling, by a resetting sub-circuitry, a first node to be electrically connected to a reference voltage input end, and controlling, by the resetting sub-circuitry, a second node to be electrically connected to an initial voltage input end, and under the control of an output control end, controlling, by an output control sub-circuitry, a first voltage input end to be electrically disconnected from the second node, and controlling, by the output control sub-circuitry, the first node to be electrically disconnected from a power source voltage output end; and at a power source voltage output stage, under the control of the resetting control end, controlling, by a resetting sub-circuitry, the first node to be electrically disconnected from the reference voltage input end, and controlling, by the resetting sub-circuitry, the second node to be electrically disconnected from the initial voltage input end, and under the control of the output control end, controlling, by the output control sub-circuitry, the first voltage input end to be electrically connected to the second node, and controlling, by the output control sub-circuitry, the first node to be electrically connected to the power source voltage output end, to output a power source voltage to the power source voltage output end, and control power source voltage input ends of all the pixel circuits of the display substrate to receive the power source voltage, thereby to enable the pixel driving circuitry of each pixel circuit to generate a driving current for driving the light-emitting element of the pixel circuit at a corresponding light-emitting stage.

18. A power source voltage application method for use in the display substrate according to claim 11, wherein each pixel circuit of the display substrate comprises a pixel driving circuitry and a light-emitting element, an $n^{th}$ power source voltage application circuit of the display substrate corresponds to an $n^{th}$ display region, the $n^{th}$ power source voltage application circuit comprises an $n^{th}$ energy storage sub-circuitry, an $n^{th}$ resetting sub-circuitry and an $n^{th}$ output control sub-circuitry, the $n^{th}$ resetting sub-circuitry is connected to an $n^{th}$ resetting control end, the $n^{th}$ output control sub-circuitry is connected to an $n^{th}$ output control end, the $n^{th}$ display region corresponds to an $n^{th}$ voltage application period, the $n^{th}$ voltage application period comprises an $n^{th}$ resetting stage and an $n^{th}$ power source voltage output stage arranged one after another, an $m^{th}$ power source voltage output stage comprises a first output time period and a second output time period arranged one after another, where n is a positive integer smaller than or equal to N, m is a positive integer smaller than N, and N is an integer greater than 1, wherein the power source voltage application method comprises, within the $n^{th}$ voltage application period:

at the $n^{th}$ resetting stage, under the control of the $n^{th}$ resetting control end, controlling, by the $n^{th}$ resetting sub-circuitry, a first end of the $n^{th}$ energy storage sub-circuitry to be electrically connected to a reference voltage input end, and controlling, by the $n^{th}$ resetting sub-circuitry, a second end of the $n^{th}$ energy storage sub-circuitry to be electrically connected to an initial voltage input end, and under the control of the $n^{th}$ output control end, controlling, by the $n^{th}$ output control sub-circuitry, a first voltage input end to be electrically disconnected from the second end of the $n^{th}$ energy storage sub-circuitry, and controlling, by the $n^{th}$ output control sub-circuitry, the first end of the $n^{th}$ energy storage sub-circuitry to be electrically disconnected from the $n^{th}$ power source voltage output end; and at the $n^{th}$ power source voltage output stage, under the control of the $n^{th}$ resetting control end, controlling, by the $n^{th}$ resetting sub-circuitry, the first end of the $n^{th}$ energy storage sub-circuitry to be electrically disconnected from the reference voltage input end, and controlling, by the $n^{th}$ resetting sub-circuitry, the second end of the $n^{th}$ energy storage sub-circuitry to be electrically disconnected from the initial voltage input end, and under the control of the $n^{th}$ output control end, controlling, by the $n^{th}$ output control sub-circuitry, the first voltage input end to be electrically connected to the second end of the $n^{th}$ energy storage sub-circuitry, and controlling, by the $n^{th}$ output control sub-circuitry, the first end of the $n^{th}$ energy storage sub-circuitry to be electrically connected to the $n^{th}$ power source voltage output end, to output the power source voltage to the $n^{th}$ power source voltage output end, and control the power source voltage input ends of all the pixel circuits in the $n^{th}$ display region to receive the power source voltage, thereby to enable the pixel driving circuitry of each pixel circuit in the $n^{th}$ display region to generate a driving current for driving the light-emitting element of the pixel circuit at a corresponding light-emitting stage, wherein the first output time period of the $m^{th}$ power source voltage output stage is a resetting stage comprised in an $(m+1)^{th}$ voltage application period, where m is a positive integer smaller than N.

19. The power source voltage application method according to claim 18, wherein when the display substrate comprises at least two power source voltage application circuits and a current power source voltage application circuit is outputting the power source voltage at the power source voltage output stage, a next power source voltage application circuit is reset within the first output time period of the power source voltage output stage.

20. A display device, comprising the display substrate according to claim 9.

* * * * *